US005457821A

United States Patent [19]

Kiefer

[11] Patent Number: 5,457,821

[45] Date of Patent: Oct. 17, 1995

[54] HAT SIMULATING A FRIED EGG

[76] Inventor: Raymond D. Kiefer, 105 Shady La., Spring City, Pa. 19475

[21] Appl. No.: 199,950

[22] Filed: Feb. 22, 1994

[51] Int. Cl.[6] ..... A42B 1/00

[52] U.S. Cl. ..... 2/195.1; 2/171; 2/195.2; D2/872

[58] Field of Search ..... 2/171, 175.1, 195.1, 2/195.2, 195.3, 195.4; D2/865, 869, 872, 873, 874, 876, 879, 882, 884, 886, 893

[56] References Cited

U.S. PATENT DOCUMENTS

D. 170,061 7/1953 Maxwell et al. ..... D2/886

D. 267,285 12/1982 Lipschutz ..... D2/872

FOREIGN PATENT DOCUMENTS 292451 6/1928 United Kingdom ..... 2/195.3

*Primary Examiner*—Diana Biefeld

*Attorney, Agent, or Firm*—Frederick J. Olsson

[57] ABSTRACT

A novelty hat in the form of a baseball cap has a yellow colored dome shaped top and a white colored brim, the outer periphery of which is irregular and part of which projects outwardly to form a visor. On the head of the wearer the hat makes the visual impression of a fried egg.

2 Claims, 2 Drawing Sheets

HAT SIMULATING A FRIED EGG

This invention relates to a novelty hat which when on or off the head creates the appearance of an egg which is fried or is being fried sunny-side up.

The hat finds utility, for example, as an attention-getting item in-connection with promotional activities at trade shows, conventions, and the like.

Further the hat is useful in connection with egg sale promotion in the egg industry.

In addition to use in connection with commercial activities as noted above, the hat may be employed in anti-drug campaigns for schools, youth organizations and the like where conventional anti-drug slogans and/or symbols may be incorporated on the hat.

The hat may be arranged in various configurations such as, for example, baseball caps, bicyclist caps, and rain hats and the like while maintaining the sunny-side up appearance.

The structure of the hat of the invention will be explained below in connection with the following drawings wherein.

Figure 1:
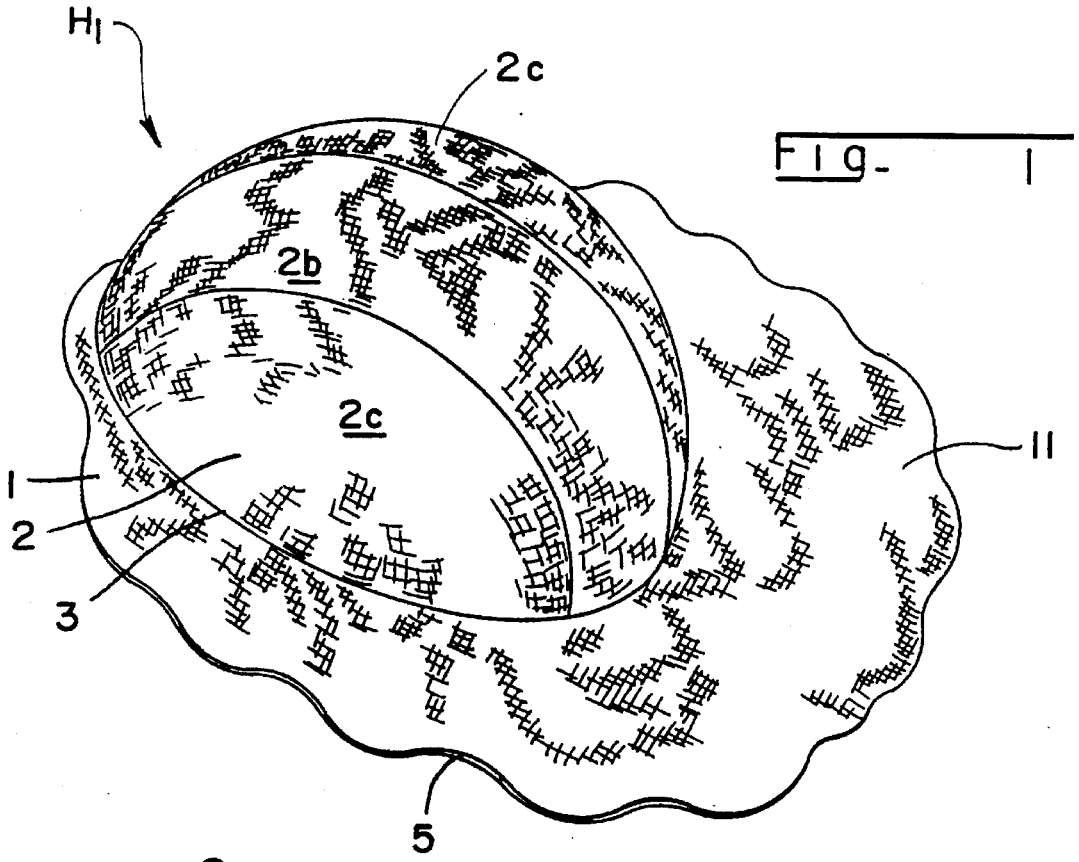
FIG. 1 is a perspective view of the hat of the invention.
Figure 2:
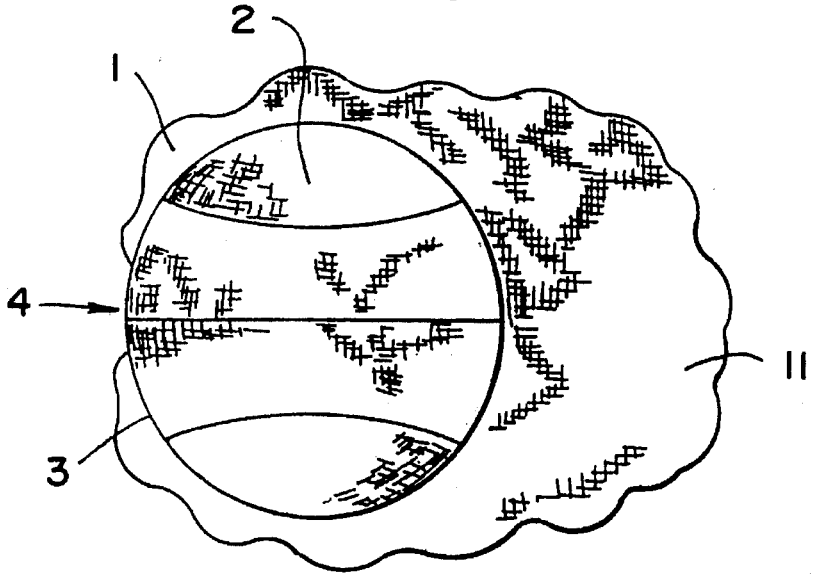
FIG. 2 is a plan view of the hat of FIG. 1 in reduced size.
Figure 3:
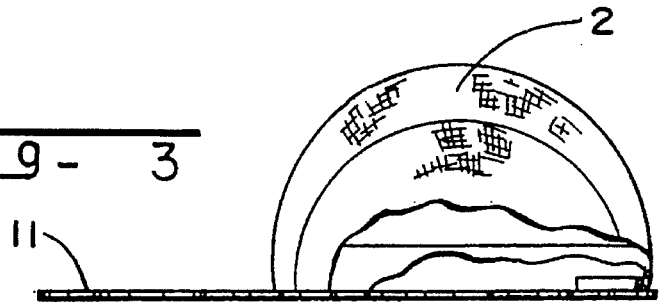
FIG. 3 is a side elevational view of the hat of FIG. 2.

The hat $H_1$ illustrated as in FIG. 1 is the cap version and includes the brim 1 and the top 2.

The brim is planar and extends projects outwardly from the lower edge 3 of the cap 1. The brim also almost completely surrounds the cap being discontinuous at the area noted at 4.

Figure 4:
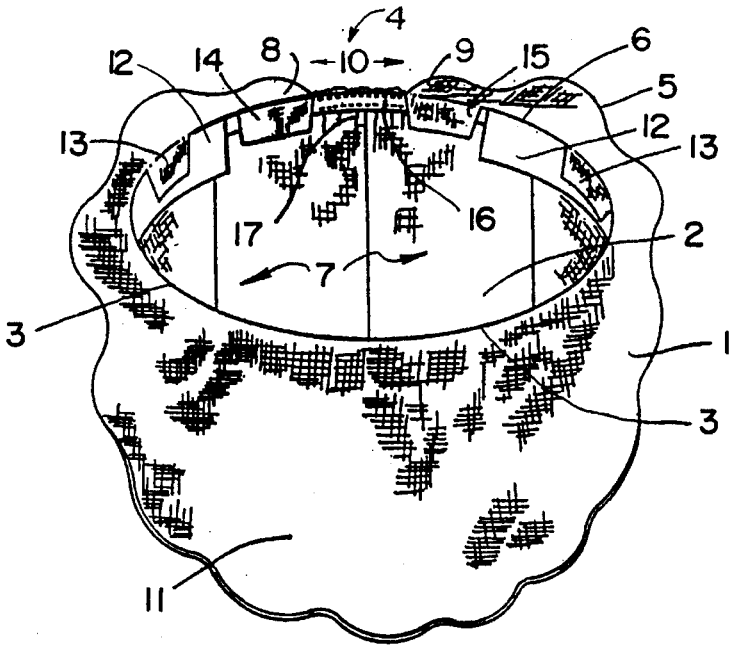
FIG. 4 is a perspective view showing the bottom of the hat of FIG. 1 illustrating stretchable means for accommodating different head sizes.

The brim includes the outer edge 5 and an inner edge 6 (best seen in FIG. 4). The outer edge 5 has an undulating or irregular shape.

The lower edge 3 of the top and the inner edge 6 of the brim are aligned and adjacent one another. This forms a head opening 7 for passing the head of a wearer. It will be observed that the brim is separated in the area noted at 4. The ends 8 and 9 form an adjustment slot 10 which extends between the inner and outer edge of the brim.

In the area opposite to the area 4, the brim is extended and shaped to form a visor 11. It will be seen that the section forming the visor extends or projects outwardly substantially more than the remaining section of the brim. Thus, the heat has a baseball cap or cyclist cap configuration.

The amount which the brim extends outwardly from the hat and the shape of the outer edge can be varied to suit the designer or be a function of the type of hat.

The brim and top are secured together as noted following.

Extending around inner edge 6 of the brim and into the interior of the top 2 is a liner strip 12. The outer edge of the liner strip 12 is stitched to the lower edge 3 of the top. The brim 1 has several tabs 13 which engage the liner strip 12 and are stitched thereto.

The tabs 14 and 15 of the brim 1 engage the elastic strip 16 which extends across the adjustment slot 10. The tabs 14 and 15 and the elastic strip 16 are stitched to the top 2. In the area 4, the material of the top is gathered as noted at 17 the folds of which are stitched to the elastic strip 16.

If the hat is put on a head which is larger that the opening 7, it will be apparent that the gathered area 17, the elastic band 16 and the adjustment slot 10 cooperate to provide for the ends 8 and 9 of the brim to move apart and this movement allows the opening 7 to increase in size.

The brim 1 is made from a material which is white in color and flexible but having memory so that if manually bent in to a curved shape it will return to the planar form when the bending force is removed. The brim may be formed, for example, from semi-stiff backing or resilient cardboard or plastic covered with natural or synthetic fabric.

The top 2 is made from material which is yellow in color and is flexible in the sense of being crushable. A memory characteristic like the brim is not required. The top is formed from separate pieces 2*a*, 2*b*, and 2*c* which are stitched together. The top is formed from natural or synthetic fabric.

From the foregoing it will be readily seen that the configuration of the top and the brim together with the yellow and white colors provide for the hat to make a visual impression of an egg which has been or is being fried sunny-side up.

The term sunny-side up is used in the conventional dictionary sense; i.e. an egg being fried or fried on one side only with the unbroken yolk on the upper side.

Figure 5:
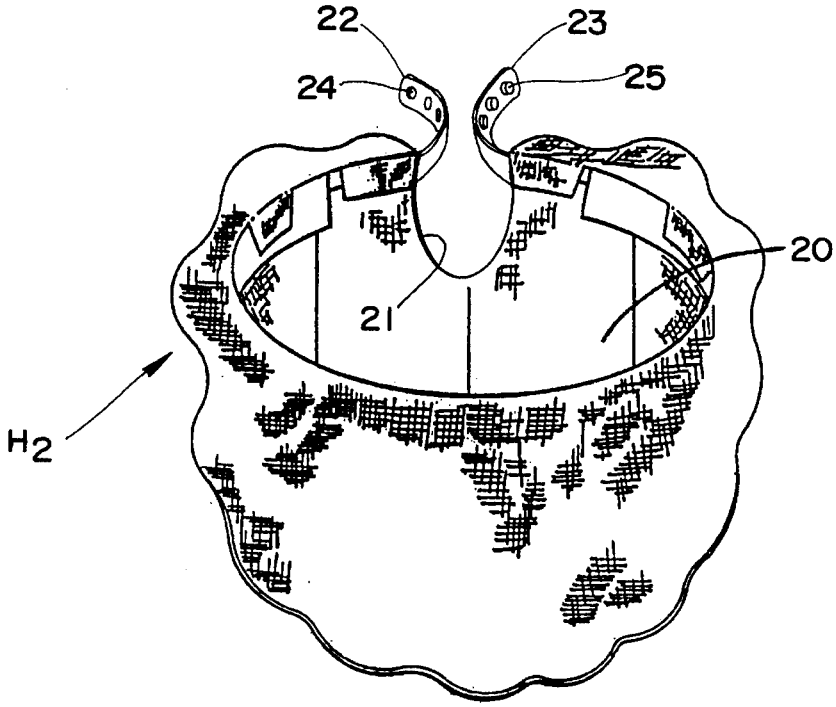
FIG. 5 is view like in FIG. 4 and illustrating tab means for accommodating different head sizes.

The hat H2 of FIG. 5 has the same construction as the hat $H_1$ with the exception of the means which permits the head opening to change in size.

In FIG. 5, the top 20 has a wide slot 21 and the gathering 17 and the elastic strip 16 are eliminated. A pair of flexible tabs 22 and 23 are secured to the top on opposite sides of the slot 20.

The tab 22 is formed with holes 24 and tab 23 is formed with projections 25 which can be pressed into and removed from the holes.

The slot 21 allows the brim and top to move so as to change the size of the head opening. By choosing the appropriate holes and placing the projections therein the size of the head opening can be matched to head size.

Before closing, it is pointed out that any of the hats mentioned above can be made in standard size or custom fitted form by eliminating the elastic band 16 and gathering 17 of FIG. 4 and by eliminating the slot 21 and tabs 22 and 23 of FIG. 5. It is preferred that in the custom fitted form or in the standard form, the brim extends completely around the top.

I claim:

1. A novelty hat comprising:

an annular, generally planar brim and a generally dome-shaped top connected thereto, the brim extending substantially around the top and projecting outwardly therefrom;

one section of the brim being formed as a visor by projecting outwardly substantially more than the remaining section of the brim:

said brim and said top each being configured for fitting on the head of a person;

said brim and said top having means to condition the brim and top to accommodate heads of different sizes;

the material forming said top being yellow in color and the material forming said brim being white in color and the periphery of the brim having an irregular shape, and the material forming said brim being flexible with memory so that if manually bent the brim will return to said planar condition; and said configuration of said top and said brim and said yellow and white colors providing that when the hat is on the head of a wearer the hat makes a visual impression of an egg fried or being fried sunny-side up.

2. A novelty hat comprising:

an annular, generally planar brim and a generally dome-shaped top connected thereto, the brim extending around the top and at said connection, the brim extending outwardly from said top;

said brim and said top each being configured for fitting on the head of a person;

the material forming said top being yellow in color and the material forming said brim being white in color and the periphery of the brim having an irregular shape; and said configuration of said top and said brim and said yellow and white colors providing that when the hat is on the head of a wearer the hat makes a visual impression of an egg fried or being fried sunny-side up.

* * * * *